US007485825B2

(12) United States Patent
Nishikawa et al.

(10) Patent No.: US 7,485,825 B2
(45) Date of Patent: Feb. 3, 2009

(54) PUSH-TYPE VEHICLE SWITCH

(75) Inventors: Hisashi Nishikawa, Ika-gun (JP); Masaru Shimizu, Yawata (JP); Hiroyuki Kosaka, Tsuruga (JP); Yoshiyuki Nakade, Tsuruga (JP); Toru Arakawa, Nishinomiya (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/289,616

(22) Filed: Nov. 30, 2005

(65) Prior Publication Data

US 2006/0137965 A1 Jun. 29, 2006

(30) Foreign Application Priority Data

Dec. 27, 2004 (JP) ..... 2004-376045
Jun. 13, 2005 (JP) ..... 2005-171985

(51) Int. Cl.
*H01H 13/02* (2006.01)

(52) U.S. Cl. ..... 200/520; 200/531; 200/341

(58) Field of Classification Search ..... 200/520, 200/530, 531, 341, 16 R, 16 A–16 D, 51.16
See application file for complete search history.

(56) References Cited

U.S. PATENT DOCUMENTS

| | | | | | |
|---|---|---|---|---|---|
| 2,526,061 | A * | 10/1950 | Batcheller | 200/532 |
| 3,794,147 | A * | 2/1974 | Shellhause | 200/61.86 |
| 3,889,077 | A * | 6/1975 | Hayashi | 200/61.25 |
| 4,181,834 | A * | 1/1980 | Kyonomine | 200/61.89 |
| 4,297,550 | A * | 10/1981 | Leighton | 200/61.89 |
| 4,356,365 | A * | 10/1982 | Siiberg | 200/83 J |
| 5,141,295 | A * | 8/1992 | Burgdorf et al. | 200/83 R |
| 6,326,570 | B1 * | 12/2001 | Fujii et al. | 200/520 |
| 6,512,191 | B1 | 1/2003 | Makino et al. | 200/531 |
| 6,653,582 | B2 * | 11/2003 | Kasakawa et al. | 200/86.5 |
| 2003/0111328 | A1 * | 6/2003 | Kasakawa et al. | 200/86.5 |
| 2005/0167253 | A1 * | 8/2005 | Nakade et al. | 200/270 |

* cited by examiner

*Primary Examiner*—Elvin Enad
*Assistant Examiner*—M. Fishman
(74) *Attorney, Agent, or Firm*—Steptoe & Johnson LLP

(57) ABSTRACT

The push-type vehicle switch has a case, an actuator, a movable contact, and a cap made of elastic material. The case has an opening and a fixed contact implanted inside thereof. The actuator is contained in the case reciprocably. The movable contact is provided facing the fixed contact and connects to and disconnects from the fixed contact according to reciprocable movement of the actuator. The cap covers the opening of the case.

7 Claims, 7 Drawing Sheets

PUSH-TYPE VEHICLE SWITCH

BACKGROUND OF THE INVENTION

1. Field of the Invention

The present invention relates to a push-type vehicle switch mainly used for lighting control of a stop lamp when operating a brake pedal of an automobile.

2. Background Art

In recent years, a large number of push switches that works by pressing have been used for lighting control of a stop lamp in a vehicle when operating a brake pedal of an automobile. A description is made for such a conventional push-type vehicle switch with reference to FIG. 7. FIG. 7 is a sectional view of the conventional push-type vehicle switch.

Case 1, made of insulating resin, is substantially tubular with its top surface open. Actuating shaft 2 is contained in case 1 movably up and down. Case 1 has a plurality of fixed contacts 3 implanted therein with terminals 3A projecting beyond a bottom surface thereof. Movable contact 4, made of metal, is pressed against fixed contacts 3 from below by press contact spring 5 that is attached between movable contact 4 and the bottom surface of case 1 in a slightly pressed state. Fixed contacts 3 are electrically connected with each other through movable contact 4. A switch contact is thus formed.

Return-spring 6 is attached between a bottom surface of actuating shaft 2 and the bottom surface of case 1 in a slightly pressed state, to bias actuating shaft 2 upward. Operation portion 2A, at the top end of actuating shaft 2, projects upward through a through-hole provided in the center of cover 7 covering the opening on the top surface of case 1. In this way, a push-type vehicle switch is composed.

A push-type vehicle switch thus composed is generally attached before the brake pedal of an automobile, with operation portion 2A being pressed on an arm (not illustrated). Then terminal 3A of fixed contact 3 is connected to the stop lamp with a connector or the like.

With the brake pedal not being depressed by a driver, operation portion 2A is pressed downward by the arm, press contact spring 5 and return-spring 6 are pressed, and movable contact 4 moves downward to separate from fixed contacts 3. Consequently, fixed contacts 3 are electrically disconnected and the stop lamp remains turned off.

With the brake pedal depressed, the arm separates from operation portion 2A to remove the pressing force, and thus actuating shaft 2 moves upward owing to the elastic return force of return-spring 6. At this moment, movable contact 4 is pressed by press contact spring 5 to be pressed against fixed contacts 3, causing fixed contacts 3 to be electrically connected with each other. This action turns on the stop lamp. Such a push switch is disclosed in Japanese Patent Unexamined Publication No. 2001-297654, for example.

However, such a switch is usually used near the brake pedal, exposed to lubricating oil, a relatively large amount of dust, and the like. Therefore, it is required to prevent these undesired substances from entering the switch through the clearance between case 1 and cover 7, actuating shaft 2 and cover 7 at the through-hole, and the like. In order to improve resistance against oil and dust, the entire switch is covered with a rubber cover, or the clearance between case 1 and cover 7 is sealed with an adhesive or the like. Consequently, the switch is difficult to assemble and needs a relatively long manufacturing time.

SUMMARY OF THE INVENTION

A push-type vehicle switch according to the present invention has a case, an actuator, a movable contact, and a cap made of elastic material. The case has an opening and a fixed contact implanted inside thereof. The actuator is contained in the case reciprocably. The movable contact provided facing the fixed contact connects to and disconnects from the fixed contact according to reciprocable movement of the actuator. The cap covers the opening of the case. As a result that the opening of the case containing the movable contact and the fixed contact is covered with the cap in this way, this push switch is easy to assemble and excellent in resistance against oil and dust.

DETAILED DESCRIPTION OF THE INVENTION

Figure 1:
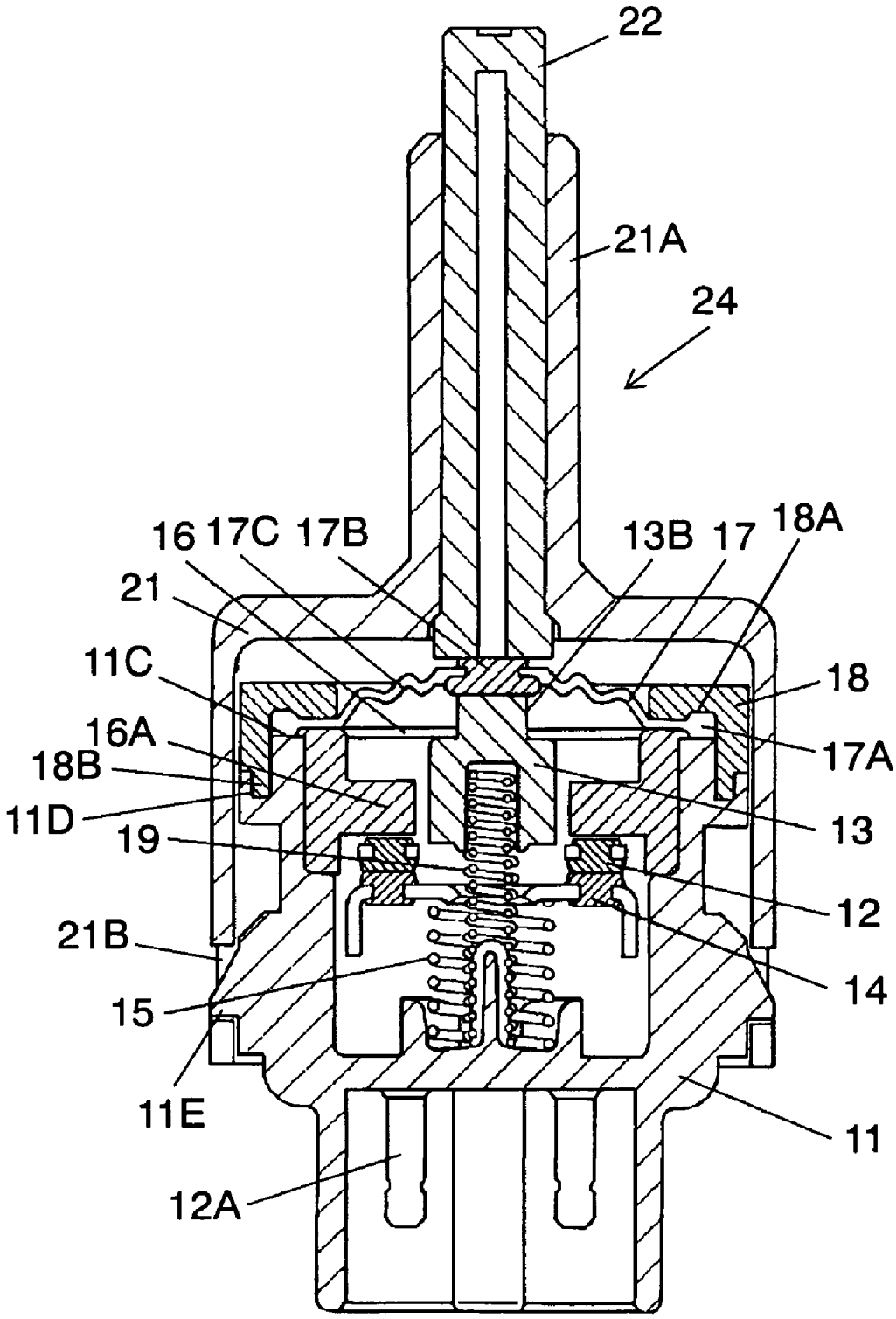
FIG. 1 is a sectional view of a push-type vehicle switch according to an embodiment of the present invention.
Figure 2:
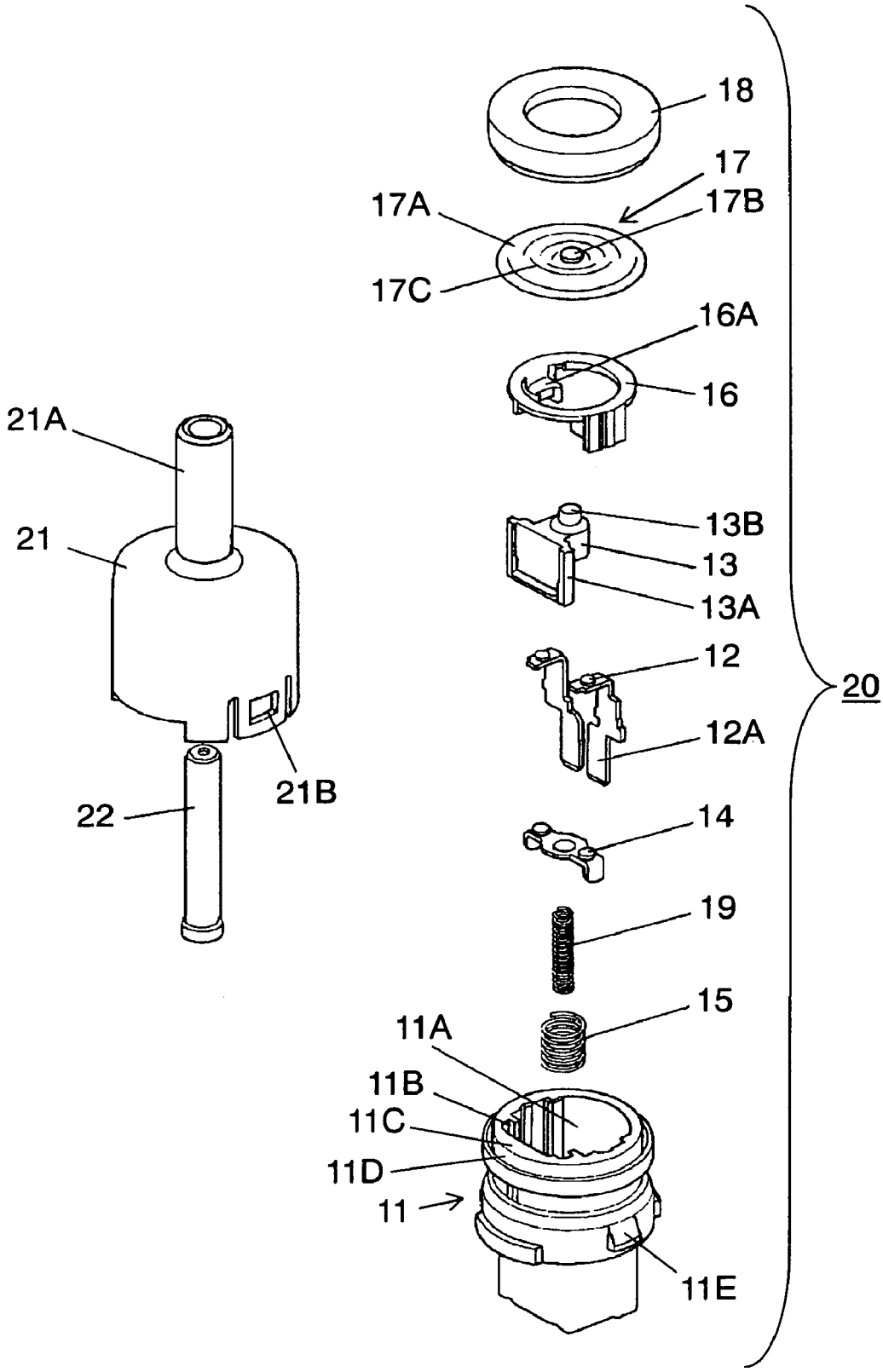
FIG. 2 is an exploded perspective view of the push switch shown in FIG. 1.

FIG. 1 is a sectional view of a push-type vehicle switch according to an embodiment of the present invention. FIG. 2 is an exploded perspective view of the push-type vehicle switch. Case 11 is open at its top surface and substantially tubular. Case 11 is made of insulating resin such as polybutylene terephthalate (PBT) and acrylonitrile butadiene styrene (ABS). The case has fixed contacts 12 implanted inside thereof, with terminals 12A projecting beyond the bottom surface thereof.

The side of actuator 13 is formed thereon with substantially flat-shaped slider 13A, and the top surface is formed thereon with convex receiver 13B. Both ends of slider 13A are inserted into a pair of guides 11B, groove-like and provided on the inner wall of case 11. Actuator 13 is contained in case 11 movably up and down. In other words, actuator 13 is contained in case 11 reciprocably. Actuator 13 is made of insulating resin such as PBT and ABS as well.

Movable contact 14, substantially U-shaped, has contacts fastened to both ends of a conductive plate, and arranged below fixed contacts 12, facing them. Movable contact 14 is pressed against fixed contacts 12 from below by press contact spring 15 attached between the bottom surface of case 11 and movable contact 14 in a slightly pressed (deformed) state. In other words, press contact spring 15 presses movable contact 14 toward cap 17. Fixed contacts 12 are electrically connected through movable contact 14. A switch contact is thus formed.

Spacer 16, substantially ring-shaped, is composed of insulating resin such as PBT and ABS. Spacer 16 restricts upward movement of actuator 13 which is arranged above fixed contacts 12. Retainer 16A, extending downward of the inner circumference, retains fixed contacts 12 from above.

Cap 17, substantially disk-like, covers opening 11A of case 11. Cap 17 is made of rubber such as nitrile-butadiene rubber, ethylene-propylene rubber, and silicon rubber; or elastic material such as elastomer. Thick-walled part 17A, ring-like and provided on the outer circumference of cap 17, is pressed by and interposed between recess 18A on the inner circumference of holding member 18 and top end 11C of case 11, to be in close contact with both of them. Cap 17 is thus attached to case 11. Holding member 18, having a through-hole at its center and substantially lid-like, is made of insulating resin such as PBT and ABS. Outer circumferential bottom end 18B of holding member 18 engages outer circumferential groove 11D on the top surface of case 11. Holding member 18 is fixed to case 11 at this part by means of ultrasonic welding, bonding, press fitting, or the like.

Touching part 17B, constricted in the middle and substantially button-like, is fastened to the substantial center of cap 17 by means of insert molding, bonding, press fitting, or the like. Touching part 17B is made of insulating resin such as PBT and ABS, harder than rubber or the like; or of metal such as stainless-steel and brass, excellent in corrosion resistance. The intermediate part between touching part 17B and thick-walled part 17A on the outer circumference is formed therein with thin-walled part 17C, substantially wave-shaped in cross section and thinner than the other parts.

Coiled return-spring 19 is attached between actuator 13 and the bottom surface of case 11 in a slightly pressed state. Return-spring 19 biases actuator 13 upward. That is, return-spring 19 presses actuator 13 toward cap 17. As the top end of slider 13A of actuator 13 touches the bottom surface of spacer 16, upward movement of actuator 13 is restricted within a certain range. Receiver 13B touches the bottom surface of touching part 17B of cap 17.

Cover 21, covering an upper part of case 11 and substantially tubular, is made of insulating resin such as PBT and ABS. Operating member 22, substantially column-shaped, is made of insulating resin such as PBT or polyoxymethylene. Operating member 22 is inserted into hollow cylinder 21A on the top of cover 21 movably up and down. The top end of operating member 22 projects from hollow cylinder 21A and the bottom end of operating member 22 touches the top surface of touching part 17B of cap 17. Operating member 22 is arranged at the opposite side of case 11 with respect to actuator 13 and provided for moving actuator 13 reciprocably via cap 17.

Engage hole 21B is provided below cover 21, and fitted to projection 11E on the outer circumference of case 11. With this makeup, cover 21 is fixed to case 11 to compose push-type vehicle switch 24.

Figure 3:
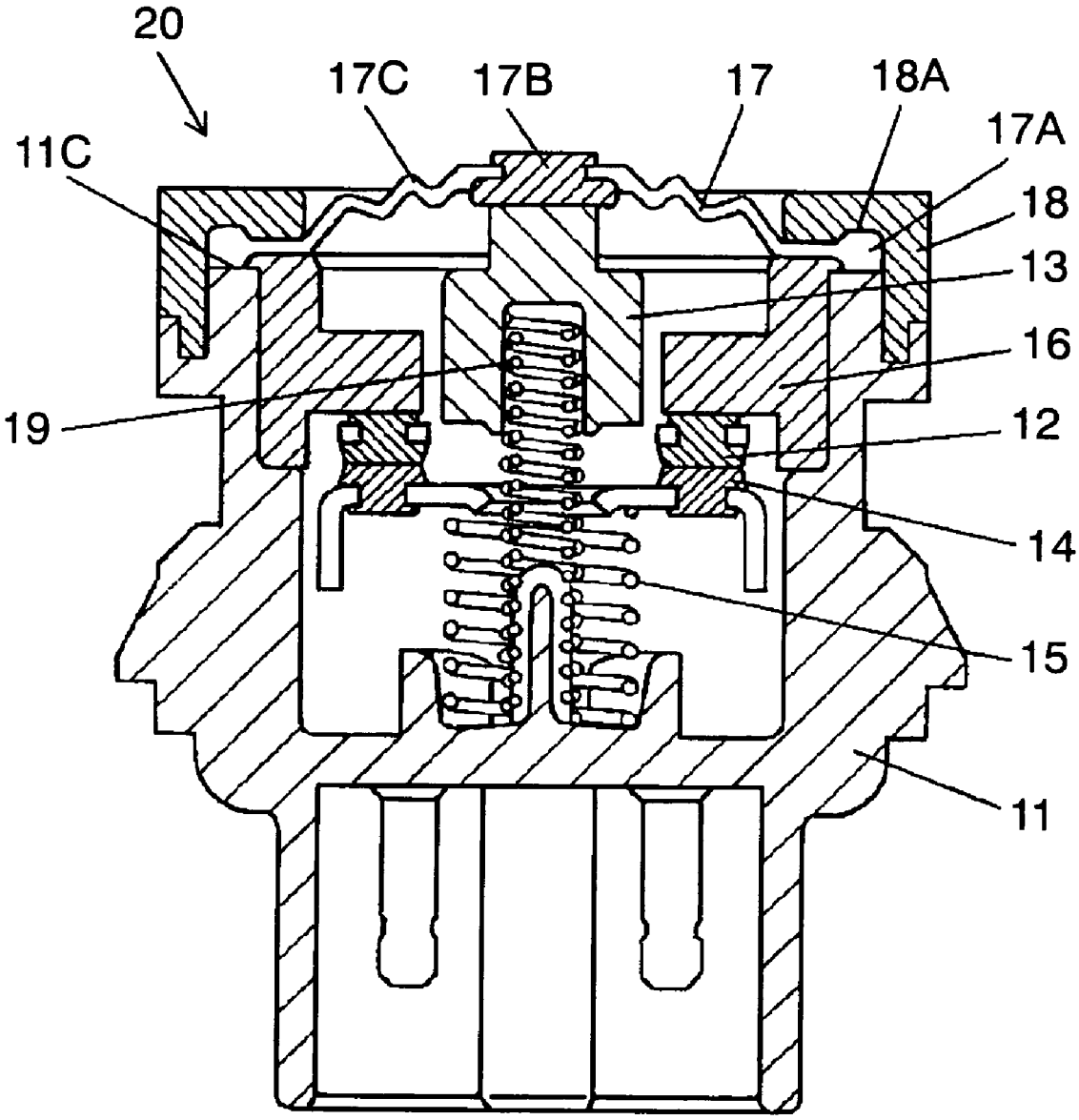
FIG. 3 is a sectional view of the push switch shown in FIG. 1, with its cover removed.

To assemble push-type vehicle switch 24, as shown in the sectional view of FIG. 3, press contact spring 15, return-spring 19, movable contact 14, actuator 13, and spacer 16 are sequentially contained in case 11 having fixed contacts 12 implanted therein. Next, cap 17 is placed on the top end 11C of case 11 so as to cover opening 11A. Then, holding member 18 is fixed to case 11 so that thick-walled part 17A of cap 17 is pressed by and interposed between recess 18A of holding member 18 and top end 11C of case 11. Operating member 22 inserted into hollow cylinder 21A and cover 21 are attached to switch unit 20 thus formed, so as to produce push-type vehicle switch 24.

In this way, switch unit 20 is once formed, and then operating member 22 and cover 21 can be attached to produce the switch. Consequently, units in the assembly process can be conveyed, stored, and undergone the other treatment easily. Further, switch unit 20 can be in common use even when using operating member 22 with different length, cover 21 with different form of mounting, or in the like case. That is, simply attaching different operating member 22 or cover 21 easily implements production flexibility. In other words, switch unit 20 is a main body of push-type vehicle switch 24, and operating member 22 is provided for improving operability of switch unit 20. Touching part of cap 17 can be pressed directly by any members which don't belong to push-type vehicle switch 24.

Figure 4:
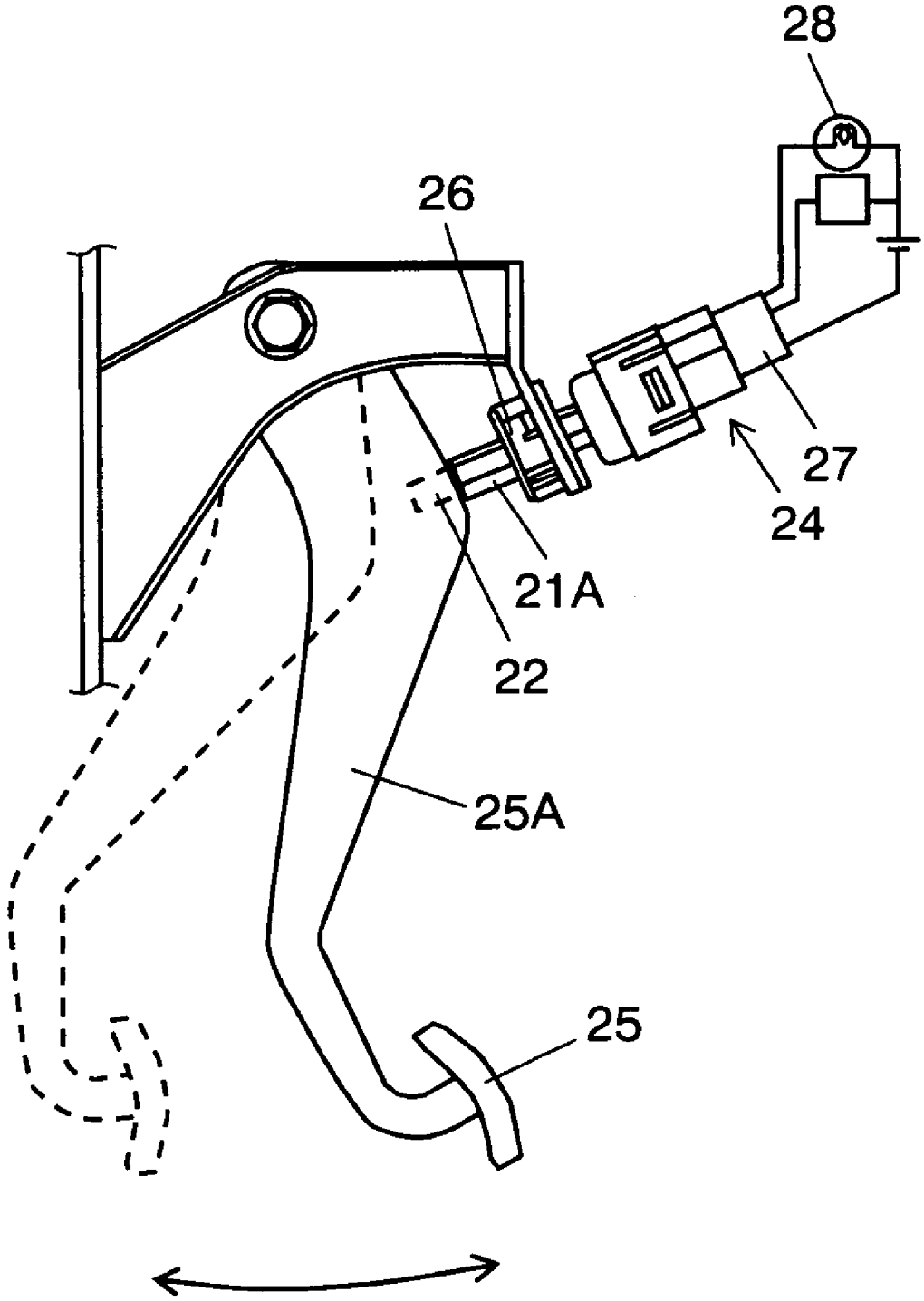
FIG. 4 is a schematic diagram illustrating an example mounting of the push switch shown in FIG. 1.

Push-type vehicle switch 24 composed in this way is attached before brake pedal 25 of an automobile by means of bracket 26 as shown in FIG. 4, so that the top end of operating member 22 is pressed against arm 25A. Terminal 12A of fixed contact 12 is connected to stop lamp 28 through connector 27.

Figure 5:
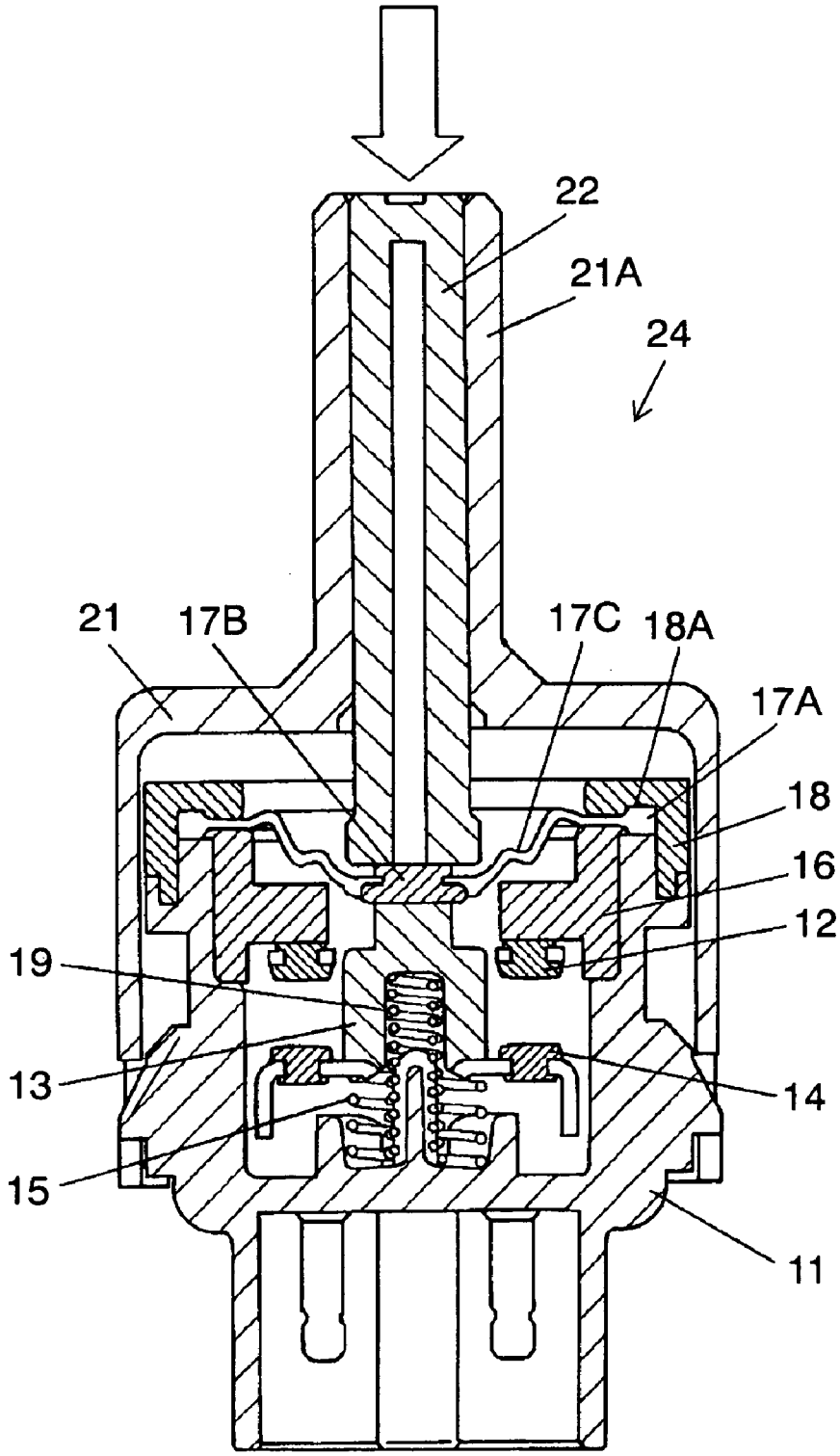
FIG. 5 is a sectional view of the push switch shown in FIG. 1, in operation.

With brake pedal 25 not being depressed, as shown in the sectional view of FIG. 5, operating member 22 is being pressed downward. Consequently, actuator 13 is pressed against operating member 22 via touching part 17B to be at the lower position. Meanwhile, thin-walled part 17C, at the circumference of touching part 17B and substantially wave-shaped, is slightly extended. At this moment, press contact spring 15 and return-spring 19 are pressed according to downward movement of actuator 13, causing movable contact 14 pressed by actuator 13 to move downward to be away from fixed contacts 12. That is, fixed contacts 12 are electrically disconnected, and thus stop lamp 28 remains turned off.

Touching part 17B is preferably harder than the circumference thereof in cap 17. This property allows touching part 17B to be resistant to deforming even if operating member 22 presses touching part 17B while operating member 22 is oblique or eccentric due to the clearance from hollow cylinder 21A, for example. Touching part 17B with this makeup, causing little friction coefficient than elastic material such as rubber, allows actuator 13 to move straight vertically without twisting under the influence of operating member 22 being oblique or eccentric. Consequently, actuator 13 moves up and down smoothly.

With brake pedal 25 being depressed, arm 25A separates from the top end of operating member 22 so as to remove the pressing force. Consequently, as shown in FIG. 1, actuator 13 is biased upward by the elastic return force of return-spring 19 and move upwardly. Movable contact 14 is as well pressed by press contact spring 15 to make contact with fixed contacts 12. Thus, fixed contacts 12 are electrically connected with each other, to turn on the stop lamp. Movable contact 14 thus connects to and disconnects from fixed contacts 12 according to reciprocable movement of actuator 13.

When actuator 13 is biased upward and moves upwardly, receiver 13B elevates operating member 22 via touching part 17B that receiver 13B touches. Here, thin-walled part 17C of cap 17 is in an extended state when touching part 17B is at the lower position. When actuator 13 moves up, thin-walled part 17C returns to its original form, substantially wave-shaped, at an intermediate position across the up-and-down movement according to movement of touching part 17B. Further, thin-walled part 17C extends as well according to upward movement of touching part 17B. In this way, actuator 13 and operating member 22 move smoothly.

Opening 11A on the top surface of case 11 is covered with cap 17. The outer circumference of cap 17 is in close contact with top end 11C of case 11. Consequently, even if foreign substances such as lubricating oil or dust enter the clearance between hollow cylinder 21A and operating member 22, or between cover 21 and case 11, such substances are blocked by cap 17. Push-type vehicle switch 24 is thus resistant to foreign substances such as lubricating oil and dust entering case 11.

As described above, according to the embodiment, cap 17 made of elastic material covers opening 11A on the top surface of case 11 containing fixed contacts 12 and movable contact 14. This makeup allows providing a push-type vehicle switch easier to be assembled and superior in resistance against oil and dust as compared to a switch with a rubber cover covering the entire switch, or with an adhesive or the like applied between a case and a cover.

As mentioned above, switch unit 20 is once formed, and then operating member 22 and cover 21 may be attached to produce a switch. Consequently, units in the assembly process can be conveyed, stored, and undergone the other treatment easily, allowing further easier assembly.

Thick-walled part 17A concatenated with the outer circumference of cap 17 is preferably provided. Consequently, thick-walled part 17A made of elastic material is pressed by holding member 18 to deform, and this elasticity force allows cap 17 to make a close contact with top end 11C of case 11 reliably. Consequently, switch unit 20 with higher airtightness is obtained with a simple makeup.

Further, thin-walled part 17C substantially wave-shaped in cross section is preferably provided at an intermediate part between touching part 17B which is the center of cap 17 and thick-walled part 17A at the outer circumference. This makeup allows thin-walled part 17C substantially wave-shaped to expand and contract according to up-and-down movement of actuator 13, and thus actuator 13 moves smoothly without undergoing an excessive load by cap 17. Consequently, movable contact 14 which operates simultaneously with actuator 13 unfailingly moves as well, thus allowing the switch contact to work reliably.

Touching part 17B, which is a part of cap 17 and touches operating member 22, is preferably made of hard insulating resin or metal. This makeup allows touching part 17B to be resistant to deforming when pressed, even if operating member 22 touches cap 17 due to being oblique or eccentric. Consequently, any twist is not generated in actuator 13, but actuator 13 smoothly moves straight vertically, allowing the switch contact to work reliably.

Next, a description is made for another makeup according to the embodiment. In the later description, elements similar to those in a makeup described using FIGS. 1 through 5 have the same reference marks as those in the previous description, and details descriptions thereof are simplified.

Figure 6:
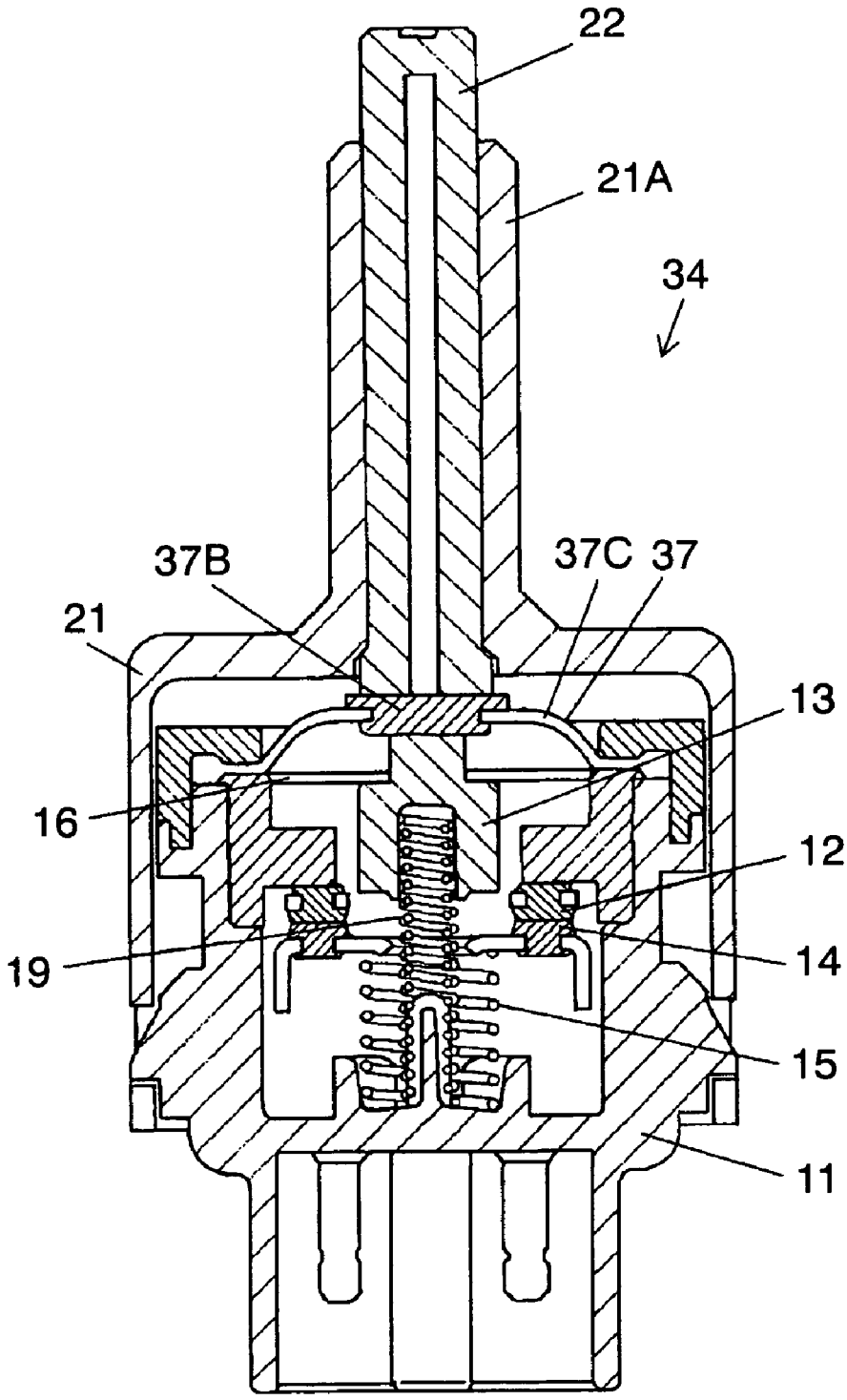
FIG. 6 is a sectional view of another push-type vehicle switch according to the embodiment of the present invention.
Figure 7:
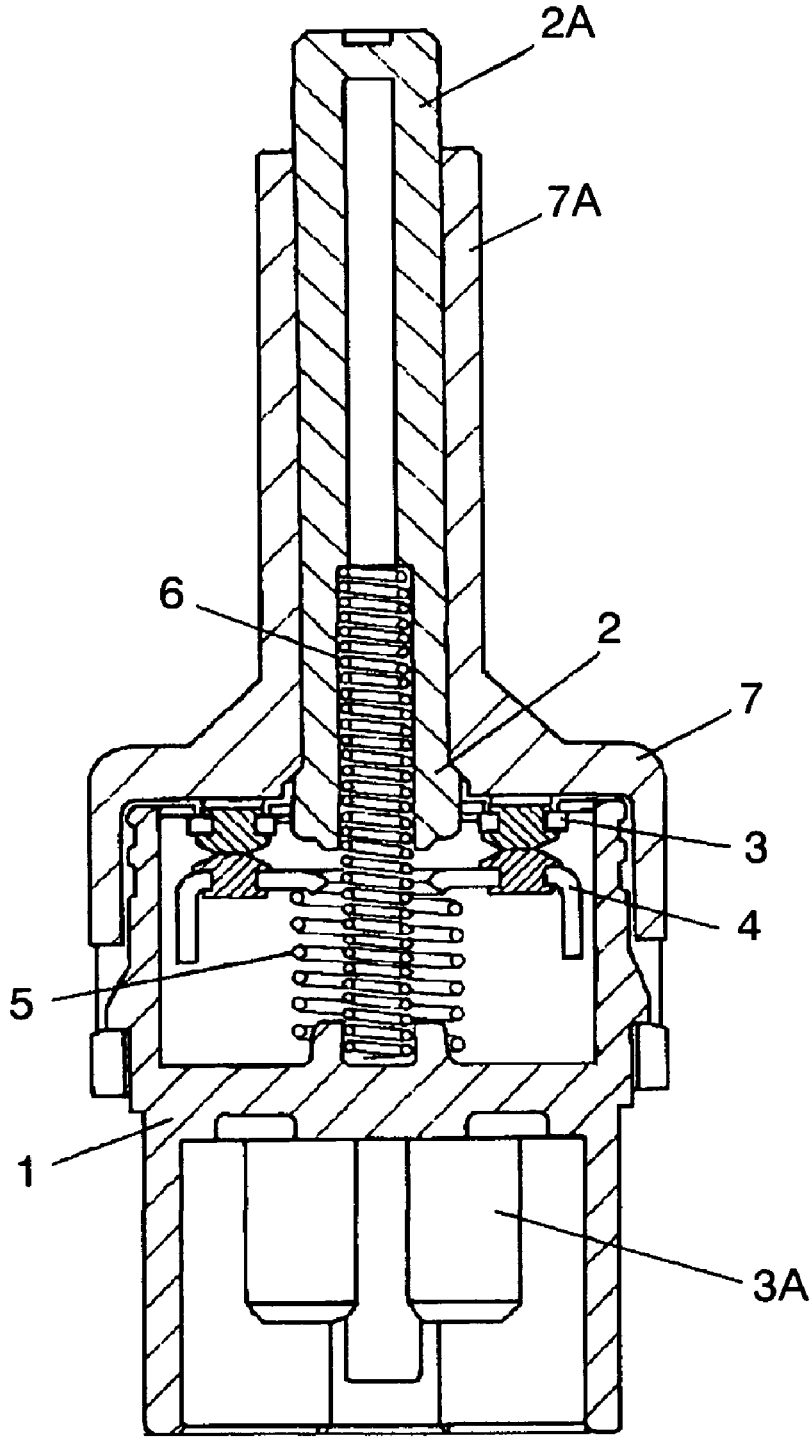
FIG. 7 PRIOR ART
FIG. 7 is a sectional view of the conventional push-type vehicle switch.

FIG. 6 is a sectional view of another switch according to the embodiment of the present invention. The makeup shown in FIG. 6 is different from that in FIG. 1 in that cap 37 is used instead of cap 17 and same otherwise. More specifically, the top surface of touching part 37B is larger than the bottom end of operating member 22 in width. In addition, thin-walled part 37C of cap 37 is substantially domical in cross section.

In push-type vehicle switch 34 thus composed, the top surface of touching part 37B is larger than the bottom end of operating member 22 in width. This makeup prevents the bottom end of operating member 22 from separating from the top surface of touching part 37B even if operating member 22 is pressed in a state of being oblique or eccentric to a relatively large extent as a result that operating member 22 rattles when pressed or tilts when obliquely pressed. That is, the bottom end of operating member 22 reliably touches the top surface of touching part 37B. Consequently, actuator 13 moves smoothly, allowing the switch contact to work reliably.

As thin-walled part 37C is substantially domical in cross section, cap 37 brings a heavy load when operating member 22 moves up and down. However, stress unlikely concentrates partially and damage involved in repetitive operation unlikely occurs when thin-walled part 37C deforms according to up-and-down movement of operating member 22.

In the makeup shown in FIG. 6, touching part 37B of cap 37 is larger than the bottom end of operating member 22 in width. This makeup allows the bottom end of operating member 22 to reliably touch the top surface of touching part 37B even in a case of being oblique or eccentric to a relatively large extent as a result that operating member 22 rattles or is pressed obliquely. Consequently, actuator 13 moves smoothly, allowing the switch contact to work reliably.

Here, as switches for lighting a stop lamp or the like, those with the facing-contact structure mentioned above are generally used. The makeup according to the present invention, namely a makeup in which a switch contact is encapsulated in a case with a cap, is applicable to other types of switches: those using a blade spring or the like for connecting and disconnecting contacts; those for detecting a door is open or closed; and those of swing type for opening and closing a door window.

Meanwhile, in this embodiment, fixed contacts 12 are provided above movable contact 14, at the side close to cap 17. This is because a switch according to this embodiment assumes to be in an on-state at no load. However, the present invention is not limited to this makeup, but fixed contacts 12 may be provided below movable contact 14, at the side close to the bottom of the case. In this makeup, the switch is in an off-state at no load and turns to an on-state with operating member 22 being pressed. In other words, fixed contacts 12 and movable contact 14 could be positioned according to an intended use.

Moreover, if a lead which is flexible and connected the terminal is connected to the movable contact, a single fixed contact may be provided.

As mentioned above, the present invention allows providing a push-type vehicle switch easy to be assemble and excellent in resistance against oil and dust. This switch is useful mainly for lighting control of a stop lamp in an automobile.

What is claimed is:

1. A push-type vehicle switch comprising:

a case having an opening therein and a fixed contact implanted inside the case;

a reciprocally moveable actuator located within the case;

a movable contact facing the fixed contact, the movable contact configured to connect to and disconnect from the fixed contact according to reciprocal movement of the actuator;

a cap made of elastic material, the cap covering the opening in the case; and an operating member configured to move the actuator reciprocally via the cap, the operating member being arranged at an opposite side of the cap with respect to the actuator, such that the operating member and the actuator are physically separated by the cap wherein the moveable contact is moveable along an axis parallel to the movement direction of the operation member.

2. The push-type vehicle switch according to claim 1, wherein the cap has a thick-walled part at an outer circumference thereof.

3. The push-type vehicle switch according to claim 1, wherein the cap has a wave-shaped thin-walled part at an intermediate part between an outer circumference and a center thereof.

4. The push-type vehicle switch according to claim 1, wherein the cap has a touching part at a position touching the operating member, the touching part being harder than a circumference thereof.

5. The push-type vehicle switch according to claim 4, wherein the touching part is larger than a bottom end of the operating member in width.

6. The push-type vehicle switch according to claim 1, wherein the operating member is configured to receive a force from outside the case and transfer the force to the actuator.

7. The push-type vehicle switch according to claim 1, wherein the actuator is configured to open an electrical connection between the fixed contact and the moveable contact when a force is applied to the actuator via the operating member.

* * * * *